United States Patent [19]

Suzuki

[11] 3,999,365

[45] Dec. 28, 1976

[54] BRAKE DEVICE APPLIED TO A ROTOR SPINDLE OF AN OPEN-END SPINNING APPARATUS

[75] Inventor: Yoshihisa Suzuki, Nagoya, Japan

[73] Assignees: Kabushiki Kaisha Toyoda Jidoshokki Seisakusho, Aichi; Daiwa Boseki Kabushiki Kaisha, Osaka, both of Japan

[22] Filed: Aug. 11, 1975

[21] Appl. No.: 605,020

Related U.S. Application Data

[63] Continuation of Ser. No. 438,212, Jan. 31, 1974, abandoned.

[30] Foreign Application Priority Data

Feb. 5, 1973 Japan ..... 48-14505

[52] U.S. Cl. ..... 57/88; 57/58.89; 57/89; 188/74; 188/84; 188/249

[51] Int. Cl.[2] ..... D01H 7/22; D01H 1/12

[58] Field of Search ..... 188/74, 84, 250 H, 259, 188/249, 166, 167, 75; 57/58.89, 58.95, 88, 104, 105

[56] References Cited

UNITED STATES PATENTS

| | | | |
|---|---|---|---|
| 2,023,407 | 12/1935 | Cobb | 57/88 X |
| 2,772,839 | 12/1956 | Morton | 188/74 X |
| 3,375,649 | 4/1968 | Bures et al. | 57/104 X |
| 3,380,558 | 4/1968 | Moore | 188/74 |
| 3,648,450 | 3/1972 | Prochazka et al. | 57/58.95 X |
| 3,711,168 | 1/1973 | Wendel et al. | 57/58.89 |
| 3,760,577 | 9/1973 | Kihara | 57/58.89 X |

FOREIGN PATENTS OR APPLICATIONS

| | | | |
|---|---|---|---|
| 1,918,161 | 10/1970 | Germany | 188/74 |
| 1,000,105 | 8/1965 | United Kingdom | 188/74 |
| 561,236 | 5/1944 | United Kingdom | 188/74 |
| 297,720 | 5/1971 | U.S.S.R. | 57/58.89 |

*Primary Examiner*—George E. A. Halvosa
*Attorney, Agent, or Firm*—Burgess, Ryan and Wayne

[57] ABSTRACT

A brake device is provided for stopping the rotation of a rotor shaft of an open-end spinning unit wherein a rotor shaft is turnably supported by a bearing assembly which is held by a bushing member by way of a resiliently yieldable member disposed between the bearing assembly and the bushing member, a brake shoe is resiliently held by a spring means disposed to a bracket of the brake device so that an excess force for urging the brake shoe toward the rotor shaft can be absorbed into the spring means.

4 Claims, 12 Drawing Figures

BRAKE DEVICE APPLIED TO A ROTOR SPINDLE OF AN OPEN-END SPINNING APPARATUS

This is a continuation of application Ser. No. 438,212, filed Jan. 31, 1974, and now abandoned.

SUMMARY OF THE INVENTION

The present invention relates to an improved brake device applied to a rotor spindle of an open-end spinning apparatus.

Generally, in the open-end spinning apparatus, the bearing assembly wherein a rotor spindle is rotatably supported is held by a bushing member by way of a resiliently yieldable member disposed between an inner cylindrical wall of the bushing member and the peripheral surface of the bearing assembly so that difficulties such as vibration or noise due to the high speed driving of the rotor can be eliminated. In the above-mentioned mechanism of the spinning unit, when it is necessary to stop the driving of a spinning unit, for example, when the driving of a spinning unit must be stopped to carry out a yarn piecing operation, a body, wherein a fiber supply means is disposed, is separated from a holder which holds the bushing member of the spinning unit, and a rotor spindle is forced to separate from a driving belt and contact a brake shoe. To attain the above-mentioned brake action, the body is turnably mounted on a pivot shaft of the frame of a spinning unit. When the body is turned about the pivot shaft, an engaging hook secured to the holder is caught by a hook member mounted on the body of the spinning unit so that the holder is held at a predetermined position where the action of the brake device can be perfectly applied to the rotor shaft. However, since the above-mentioned turning motion of the body is carried out manually, there is a possibility of excessively urging the rotor shaft toward the brake device. In this condition, the bearing assembly is forced to turn excessively about a turning center thereof which is located at a central axial position between both longitudinal ends thereof.

On the other hand, the opened portion of a spinning rotor coaxially secured to the rotor shaft is sealed by a labyrinth ring so as to prevent the invasion into the spinning rotor of an air flow, which is discharged from the spinning rotor.

Generally, to attain the above-mentioned labyrinth seal the edge of the open-end portion of the spinning rotor is provided with a circular groove formed between double circular flanges, while the labyrinth ring is provided with a cylindrical recess wherein the outer flange of the double flanges can be inserted with very small clearance. Consequently, if the bearing assembly is forced to turn excessively about the above-mentioned axial center, the double flanges of the spinning rotor may contact the facing portions of the labyrinth ring, so that the spinning rotor and/or labyrinth ring is damaged, which can result in further deterioration of the spinning equipment. To prevent the above-mentioned difficulty, it has been proposed to utilize a stop means such as a stop ring disposed between the inner cylindrical wall of the bushing member and the peripheral surface of the bearing assembly, which restricts the turning motion of the bearing assembly so as to prevent contact of the open side edge of the spinning rotor with the labyrinth ring. However, according to our experience in mill operation, it has been found that such a solution creates additional difficulties due to the accumulation of heat in the bearing assembly.

In the conventional open-end spinning apparatus, another type of brake device has also been utilized. That is, in this brake device, a brake shoe is forced to contact the rotor spindle, instead of positively urging the rotor spindle toward the stationary brake device. However, in this case, the brake action is carried out manually. However, difficulties, similar to those encountered in the first mentioned brake system still occur.

The principal object of the present invention is to eliminate the above-mentioned difficulty by utilizing an improved brake device.

To attain the above-mentioned purpose, in the present invention, the brake device is provided with a spring loaded brake shoe so that a uniform and suitable brake force can always be applied to the spinning rotor when it is necessary to stop the rotation of the spinning rotor contact of the labyrinth ring with the open side edge of the spinning rotor can thereby be absolutely prevented.

Further features and advantages of the invention will be apparent from the following description with reference to the accompanying drawings to which the scope of the invention is in no way limited.

DETAILED ILLUSTRATION OF THE INVENTION

Figure 1:
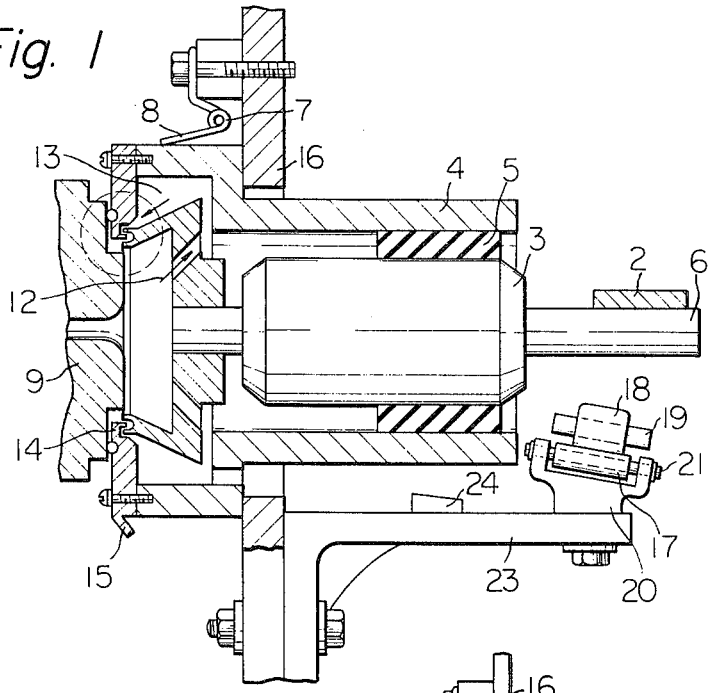
FIG. 1 is a side view, partly in section of an embodiment of the brake device according to the present invention.

Referring to FIGS. 1, 2, 3 and 4, in a device for supporting a bearing assembly of an open-end spinning unit wherein an embodiment of an improved brake device according to the present invention is utilized, a bearing assembly 3 is supported by a bushing member 4 by way of a resiliently yieldable member 5 which is disposed between an inner cylindrical wall of the bushing member 4 and a peripheral surface of the bearing assembly 3. A rotor spindle 6 is turnably supported by the bearing assembly 3 and a spinning rotor 1 is rigidly secured to an end of the rotor shaft 6 in coaxial condition therewith. To prevent the invasion into the spinning rotor 1 of the discharged air 13 which is discharged from the spinning rotor 1 through discharge apertures 12, a labyrinth ring 14 is utilized to seal the open side edges of the spinning rotor 1 as shown in FIG. 1. The bushing member 4 is turnably mounted on a pivot shaft 7 secured to a stationary bracket 16 of a spinning unit. A body 9 provided with a fiber supply device (not shown) is turnably mounted on a pivot shaft 10 secured to the bracket 16. A spring 8 is mounted on the pivot shaft 7 in such a manner that an end thereof is secured to the bracket 16 while another end thereof always urges the bushing member 4 so as to be able to position it at its spinning position where the rotor shaft 6 is positioned perpendicularly to the bracket 16 so that the spinning rotor 1 is correctly positioned with respect to the fiber supply means (not shown) disposed in the body 9.

Figure 2:
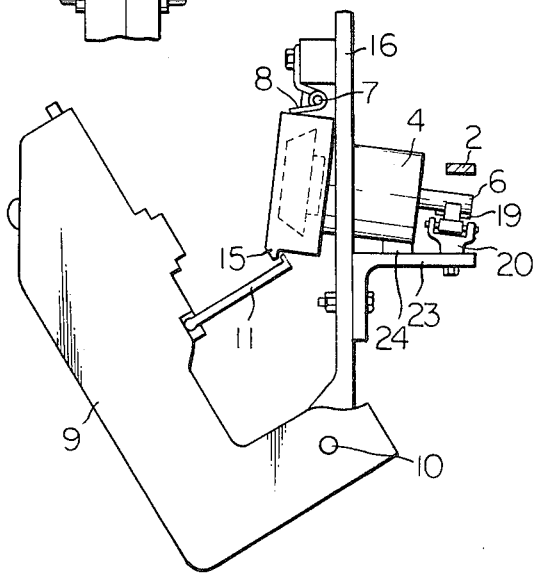
FIG. 2 is a side view of an open-end spinning unit provided with the brake device shown in FIG. 1, showing a braking position of the brake device.
Figure 3:
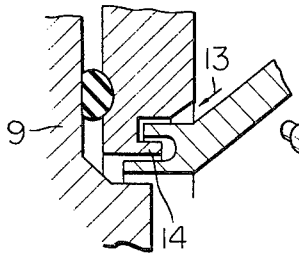
FIG. 3 is a cross sectional view of a part of the labyrinth ring engaged with an open side edge of the spinning rotor of the spinning unit shown in FIG. 2.

When it is necessary to turn the body 9 about the pivot shaft 10 so as to separate the spinning rotor from the fiber supply means, for example, when the body 9 is turned about the pivot shaft 10 as shown in FIG. 2 so as to stop the rotation of the rotor spindle 6 according to particular requirements such as the requirement for carrying out a yarn piecing operation, a hook 15 projected from the bushing member 4 is caught by a hook member 11 mounted on the body 9 when the body 9 is turned about the pivot shaft 10. Consequently, the bushing member 4 is forced to turn about the pivot shaft 7 so that a free end portion of the rotor shaft 6 is separated from the driving belt 2 and displaced to a brake means. The above-mentioned turning motion of the body 9 is carried out manually.

Figure 5:
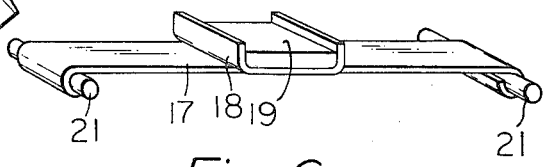
FIG. 5 is a perspective view of a spring element of the brake device utilized in the embodiment shown in FIG. 1.
Figure 6:
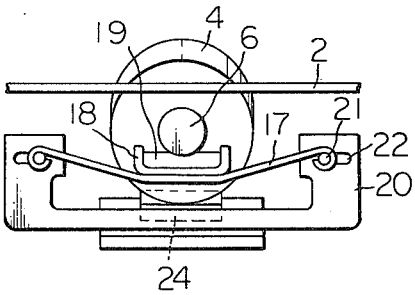
FIG. 6 is a front view of the brake device shown in FIG. 1, in a non braking position.
Figure 4:
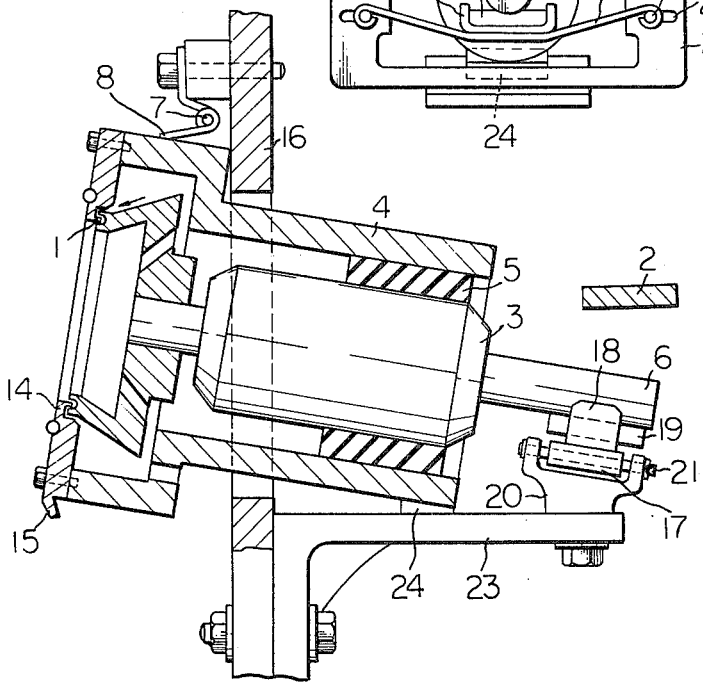
FIG. 4 is a side view, partly in section of the brake device shown in FIG. 1, in a braking position.
Figure 7:
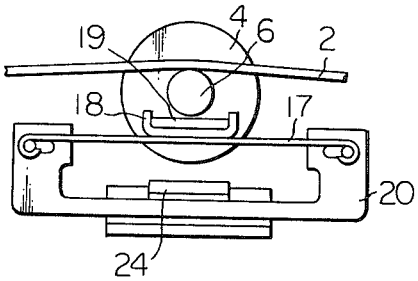
FIG. 7 is a front view of the brake device shown in FIG. 1, in a braking position.

In this embodiment, to stop the rotation of the rotor spindle 6 in a condition ensuring that possible contact of the open side edges of the spinning rotor 1 with the labyrinth ring 14 can be absolutely prevented, a brake means having a particular construction is utilized. That is, referring to FIGS. 5, 6 and 7, in the brake means of this embodiment, an auxiliary bracket 20 is rigidly mounted on a supporting bracket 23 secured to the stationary bracket 16 and a plate spring 17 is mounted on the small bracket 20 by a pair of pins 21 which are inserted into a groove 22 formed in the small bracket 20 at both ends portions thereof. A holding metal member 18 is rigidly mounted on the plate spring 17 and a brake shoe 19 is held by the metal member 18. A stopper 24 is mounted on the supporting bracket 23 at a position where the turning motion of the bushing member 4 about the pivot shaft 7 is restricted in such a manner that the rotor shaft 6 is capable of being urged against the brake shoe 19 sufficiently. As the brake shoe 19 is held by the metal member 18 secured to the plate spring 17, if the above-mentioned urging of the rotor spindle 6 against the brake shoe 19 is too strong, the plate spring 17 is deformed so that the excess turning of the bearing assembly about a turning center thereof which is located at a central axial position between both longitudinal ends thereof can be prevented. Consequently, possible contact of the open side edge of the spinning rotor 1 with the labyrinth ring 14 can be absolutely prevented.

Figure 8:
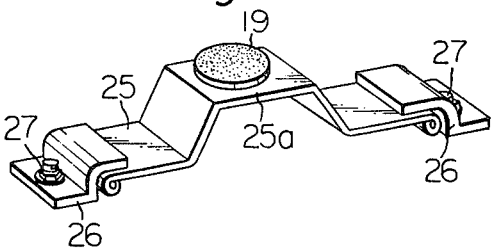
FIG. 8 is a perspective view of a modified spring element of the brake device according to the present invention.

Referring to FIG. 8, a plate spring 25 having upwardly projecting portion 25*a* provided with a brake shoe 19 secured thereon can be utilized instead of the plate spring 17 shown in FIG. 1. In this case, the plate spring is rigidly mounted on the auxiliary bracket 20 by a fastening piece 26 and a bolt 27 at both ends thereof.

Figure 9:
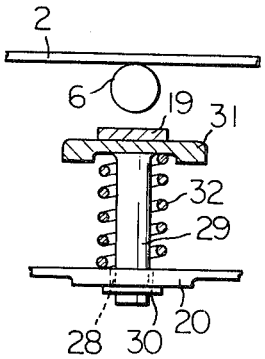
FIG. 9 is a side view of further modified spring element of the brake device according to the present invention.

In the modified embodiment of the spring element shown in FIG. 9, instead of utilizing a plate spring as shown in FIG. 1 and FIG. 8, a helical spring is utilized. That is, an aperture 28 is formed on the auxiliary bracket 20 and an upright rod 29 is inserted into the aperture 28. A stop ring 30 is secured to a bottom end portion of the rod 29 at a position below the auxiliary bracket 20 and a metal cap 31 is secured to the other end of the rod 29. A helical spring 32 is mounted on the rod 29 between the metal cap 31 and the auxiliary bracket 20. The brake shoe 19 is rigidly mounted on the metal cap 31. Consequently, when the rotor shaft 6 is strongly urged against the brake device, the brake shoe 19 can be displaced against the spring force of the helical spring 32 so that any difficulties discussed above can be satisfactorily prevented.

Figure 10:
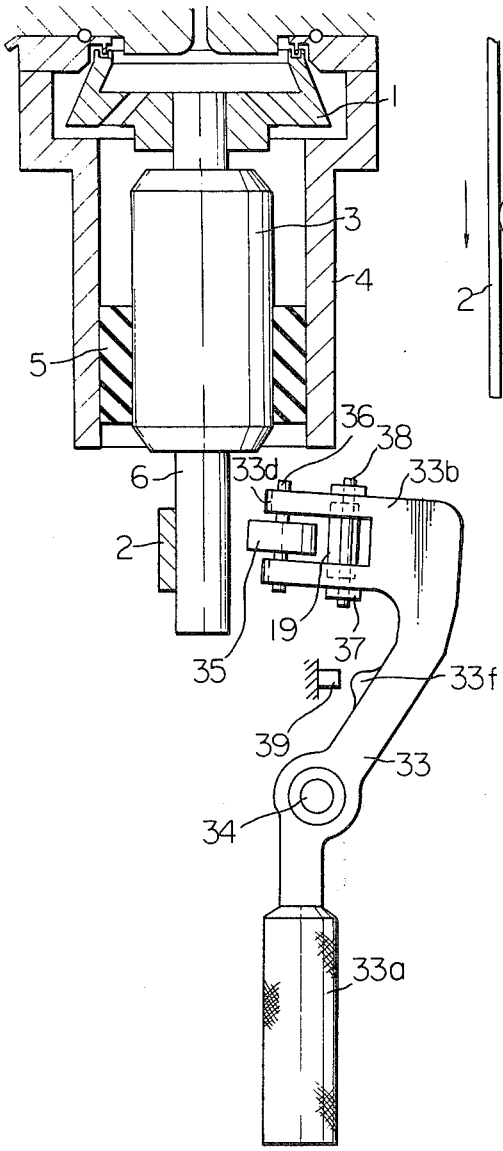
FIG. 10 is a side view of another embodiment of the brake device utilized for an open-end spinning unit according to the present invention.
Figure 11:
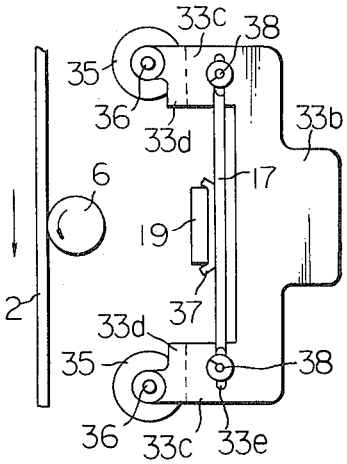
FIG. 11 is an elevational view of a main part of the brake device shown in FIG. 10, in a non braking position.
Figure 12:
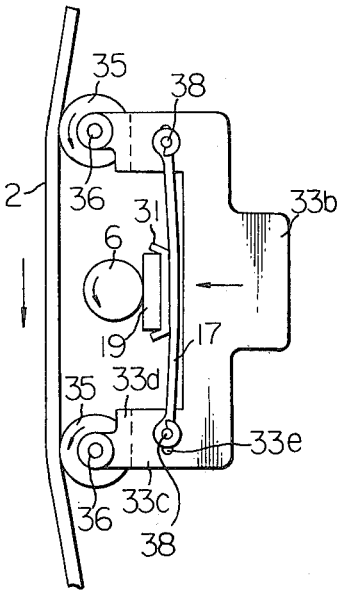
FIG. 12 is an elevational view of a main part of the brake device shown in FIG. 10, in a braking position.

In another embodiment shown in FIGS. 10, 11 and 12, the device for supporting the bearing assembly which rotatably supports a rotor spindle is quite similar to that of the first embodiment shown in FIG. 1, except for the mechanism for stopping the rotation of the rotor spindle. In this embodiment, instead of displacing the rotor spindle to the brake shoe of a stationary brake device, the brake shoe of the brake device is displaced to contact the rotor spindle. Therefore, the explanation about the supporting device of this embodiment is omitted. In this embodiment, a brake device comprises a lever 33 provided with a head portion 33*b* from which a pair of branch arms 33*c* project, a pair of rollers 35 turnably mounted on the branch arms 33*c*, and the brake shoe 19 secured to a metal piece 31 which is resiliently held by a plate spring 17 mounted on the branch arms 33*c* as shown in FIG. 11 and FIG. 12. Each branch arm 33*c* is provided with a pair of parallel portions 33*d* and the roller 35 is rotatably mounted between these portions 33*d* on a pin 36 secured to these portions 33*d*. The plate spring 17 has a structure similar to the plate spring 17 shown in FIG. 5. However, both end portions thereof are provided with cut out portions so as to be able to assemble the plate spring 17 with the branch arms 33*c* by the respective pins 38 which are inserted into the corresponding grooves 33*e* formed in the branch arms 33*c*, respectively. The arm 33 is further provided with a grip handle 33*a* formed at another free end portion thereof and the arm 33 is turnably mounted on a pivot shaft 34 secured to a frame of a spinning unit of the open-end spinning apparatus. In the above-mentioned embodiment of the brake device shown in FIG. 10, the brake shoe 19 is arranged in such a manner that when the rollers 35 are urged against the driving belt 2 so as to separate the belt 2 from the rotor spindle 6, the brake shoe 19 is capable of strongly contacting the rotor spindle 6. Consequently, in the spinning condition wherein the driving belt 2 is in contact with the rotor spindle 6, the brake shoe 19 and the rollers 35 are retracted away from the braking position thereof, as shown in FIG. 11. On the other hand, when it is necessary to stop the rotation of the rotor spindle 6, the handle 33*a* of the arm is manually turned about the shaft 34 in a counterclockwise direction shown in FIG. 10 until the rollers 35 urge the driving belt 2 toward a position where the driving belt 2 separated from the rotor spindle 6 and the brake shoe 19 contacts the rotor spindle 6 as shown in FIG. 12. In this condition, it is required to urge the brake shoe 19 strongly against the rotor spindle 6. However, as the brake shoe 19 is mounted on the plate spring 17, even though an excess force is applied, the spring 17 is deformed so that any excess turning motion of the bearing assembly 3 about the axial center between both axial ends thereof can be prevented. In other words, possible contact of the open side edge of the spinning rotor with the labyrinth ring can be absolutely prevented. In the above-mentioned embodiment, a stopper 39 is disposed to a frame of a spinning unit, and counterclockwise turning motion of the arm 33 about the shaft 34 in FIG. 10 is restricted by contact of the stopper 39 with a projection 33*f* formed on the arm 33, so that the arm 33 cannot go beyond the resilient capacity of the plate spring 17.

According to our experience, the above-mentioned brake device can be successfully applied to the conventional device for supporting the bearing assembly which rotatably supports the rotor spindle, without utilizing the resiliently yieldable member 5. That is, in this case, the bushing member 4 rigidly supports the bearing assembly 3. Consequently, when the bushing member 4 is turned about the pivot shaft 7 so as to urge the rotor spindle 6 against the brake shoe 19 of the brake device, if the brake shoe 19 is rigidly mounted on the small bracket 20, the rotor spindle 6 may turn about an axial turning center thereof in the bearing assembly so that the difficulty pointed out above may be created. However, the above-mentioned possible turning motion of the rotor spindle 6 in the bearing assembly 3 can be perfectly prevented by utilizing the above-mentioned brake device shown in FIGS. 1–10.

What is claimed is:

1. In a brake device for stopping the rotation of a rotor spindle of an open-ended spinning unit wherein a rotor spindle is turnably supported by a bearing assembly held by a bushing member by a yieldable member, said rotor spindle being driven by a driving belt, and said brake device and rotor spindle are capable of being positively brought into pressure contact with each other by a device for relatively displacing said rotor spindle and said brake device while separating said rotor spindle from said driving belt; the improvement wherein said brake device comprises a resilient member, a brake shoe on said resilient member, and bracket means for holding said resilient member in a position whereby said brake shoe contacts said rotor spindle with uniform pressure across the contact area in response to displacement of said device for relatively displacing, wherein stopper means are provided adjacent to or on said bracket for contacting a surface of one of said bracket or said bearing assembly respectively in response to a pre-determined relative displacement between said bracket and said bushing member corresponding to a predetermined pressure between said rotor spindle and said brake shoe and for applying a displacement stopping force against said contacted surface in a direction that tends to separate said rotor spindle and said brake shoe, whereby forces on said rotor spindle that may damage said bearing assembly are inhibited.

2. A brake device as recited in claim 1, wherein said resilient member comprises two rigidly secured ends and a central portion projecting in the direction of said brake shoe contact area.

3. A brake device as recited in claim 1, wherein said bracket means further comprises a mounting bracket, a pair of slots being provided in said mounting bracket, a retaining pin in each of said slots, an elongated plate being secured at each end to each of said retaining pins, said slots being oriented in a direction permitting the ends of said plate to move toward and away from each other.

4. An improved brake device according to claim 1, wherein said bracket means comprises an elongated arm having two ends, means connected intermediate said two ends of said arm for pivotally supporting said arm, a bracket mounted on one end of said arm, said bracket being provided with two slots, said resilient member comprising an elongated plate spring having two ends, means for slidably mounting the ends of said plate spring in said slots of said bracket, said brake shoe being mounted on said plate spring intermediate said two ends thereof, and said relative displacement between said brake device and said rotor spindle being provided by the rotation of said arm about said pivotal support.

* * * * *